US006503133B2

(12) United States Patent
Wuensch

(10) Patent No.: US 6,503,133 B2
(45) Date of Patent: Jan. 7, 2003

(54) ECCENTRIC PLATE GRINDING MACHINE WITH A CYLINDRICAL HOUSING

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 28 days.

(21) Appl. No.: 09/880,153

(22) Filed: Jun. 12, 2001

(65) Prior Publication Data

US 2002/0106982 A1 Aug. 8, 2002

(30) Foreign Application Priority Data

Jun. 29, 2000 (DE) ..... 100 31 761

(51) Int. Cl.[7] ..... B24B 27/03

(52) U.S. Cl. ..... 451/357; 451/344; 451/294; 451/359

(58) Field of Search ..... 451/357, 294, 451/359, 344, 358, 296, 548, 526, 490

(56) References Cited

U.S. PATENT DOCUMENTS 4,660,329 A * 4/1987 Hutchins ..... 451/357
5,018,314 A * 5/1991 Fushiya et al. ..... 451/357
5,392,568 A * 2/1995 Howard, Jr. et al. ..... 451/357
5,679,066 A * 10/1997 Butz et al. ..... 451/357
5,813,903 A * 9/1998 Amano et al. ..... 45/294
6,343,982 B1 * 2/2002 Sun ..... 451/359

FOREIGN PATENT DOCUMENTS

EP 0 559 020 B1 10/1997

* cited by examiner

*Primary Examiner*—Lee Wilson
(74) *Attorney, Agent, or Firm*—Michael J. Striker

(57) ABSTRACT

An eccentric plate grinder has a cylindrical housing having a lower region with an end-side edge, a rotatable grinding plate associated with a lower region, a ring-shaped brake positioned between the grinding plate and the edge, the grinding mechanism having an elastic lip with which it is supported on the grinding plate and applies a braking force to the grinding plate, the brake also tightly closing a suction chamber inside the housing in a region of the grinding plate from outside, the brakes having throughgoing openings for ventilating the suction chamber, and further comprising valve-shaped flaps operative for releasing and closing the throughgoing openings.

12 Claims, 2 Drawing Sheets

ECCENTRIC PLATE GRINDING MACHINE WITH A CYLINDRICAL HOUSING

BACKGROUND OF THE INVENTION

The present invention relates to an eccentric plate grinding machine with a braking means for limiting the rotary speed of the grinding plate.

The European patent document EP 0 559 020 B1 discloses such an eccentric plate grinding machine in which the grinding plate can be braked by a ring-shaped braking means arranged in the housing. The braking force can be reproducibly exactly adjustable.

In order to maintain the dimensions of the grinding machine as compact as possible and to provide a good handling, a small structural height of the friction ring is required. The friction ring must be especially small, and it is difficult to produce since all tolerances occurring during the series production of the contributing components such as the housing, the bearing or the bearing receptacle must be compensated to guarantee a constant braking action. Simultaneously the braking force under working conditions must not be too high to avoid an increased wear of the components. The filigrane and highly accurate design of the braking means leads to an expensive and complicated manufacture.

SUMMARY OF THE INVENTION

Accordingly, it is an object of the present invention to provide an eccentric plate grinder which avoids the disadvantages of the prior art.

More particularly, it is an object of present invention to provide an eccentric plate grinder, in which the braking force is automatically limited by valve-shaped flaps in the friction ring.

It is especially advantageous when power-reinforcing vacuum cleaner is connected to the eccentric plate grinding machine, since with its use a high alternating negative pressure is produced in the region of the commercial conventional friction ring. Thereby it is strongly pressed against the grinding plate, and heat is generated by high friction force. Since both braking means and the grinding plate are composed of synthetic plastic, for example rubber they are loaded with charge and wear prematurely. With the valve-shaped flaps the advantages of high suction power can be obtained without influencing the service life of the braking ring.

It is especially advantageous when the friction ring at its side which faces away from the section chamber is provided with a circumferential ring groove, which reduces the wall thickness and is provided with an elastic lip which adjoins it and extends in an axial direction toward the grinding plate. With the circumferential ring groove, the force characteristic line of the spring characteristic of the friction ring is maintained very flat. This means that the friction force, with which the braking means press against the grinding plate is approximately independent from the distance between the housing and the grinding plate by which the tolerances are determined.

It is further advantages when the region of the ring groove is formed as an elastic hinge for the movability of the elastic lip relative to the friction ring. With this film-hinge-shape connection, the movability of the elastic lip relative to the friction ring is reinforced.

It is especially advantageous when the friction ring has a U-shaped cross-section, such that its U-leg regions engage the side, preferably the end side, of the lower region and held on them. Thereby a simple, fast and light mounting of the friction ring on the housing is possible.

Moreover, it is advantageous when a further leg is connected with an inner U-leg region. It has a reduced cross-section and extends inclinedly inwardly and downwardly. It is angled inclinedly outwardly in the region of the ring groove and forms there a lip.

A further leg in this manner, because of its inclined course, is sufficiently great to carry the valve-shaped flaps. Furthermore the V-shape which is formed of the further leg and the lip contributes to a flat characteristic line for the pressing force of the lip on the upper side of the grinding plate.

Moreover, it is especially advantageous when the ring-shaped braking means have a greater diameter than the lower region of the cylindrical housing, so that the braking means extend beyond the outer contour of the housing as a bumper. The braking means prevent therefore efficiently the abutment of harder housing regions against the workpiece so as to avoid damages of the workpiece.

When the valve-shaped flaps of the friction ring moreover are formed as U-shaped or partial circle-shaped punched out sections it provides for fast, inexpensive and efficient manufacture.

Moreover, it is advantageous when the film-hinge-shaped mounting regions of the flap are formed as punched-in sections.

The gaps of the punched-in sections regulates the suction force with which the flaps are to be open, and also regulate the braking force which acts on the grinding plate.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
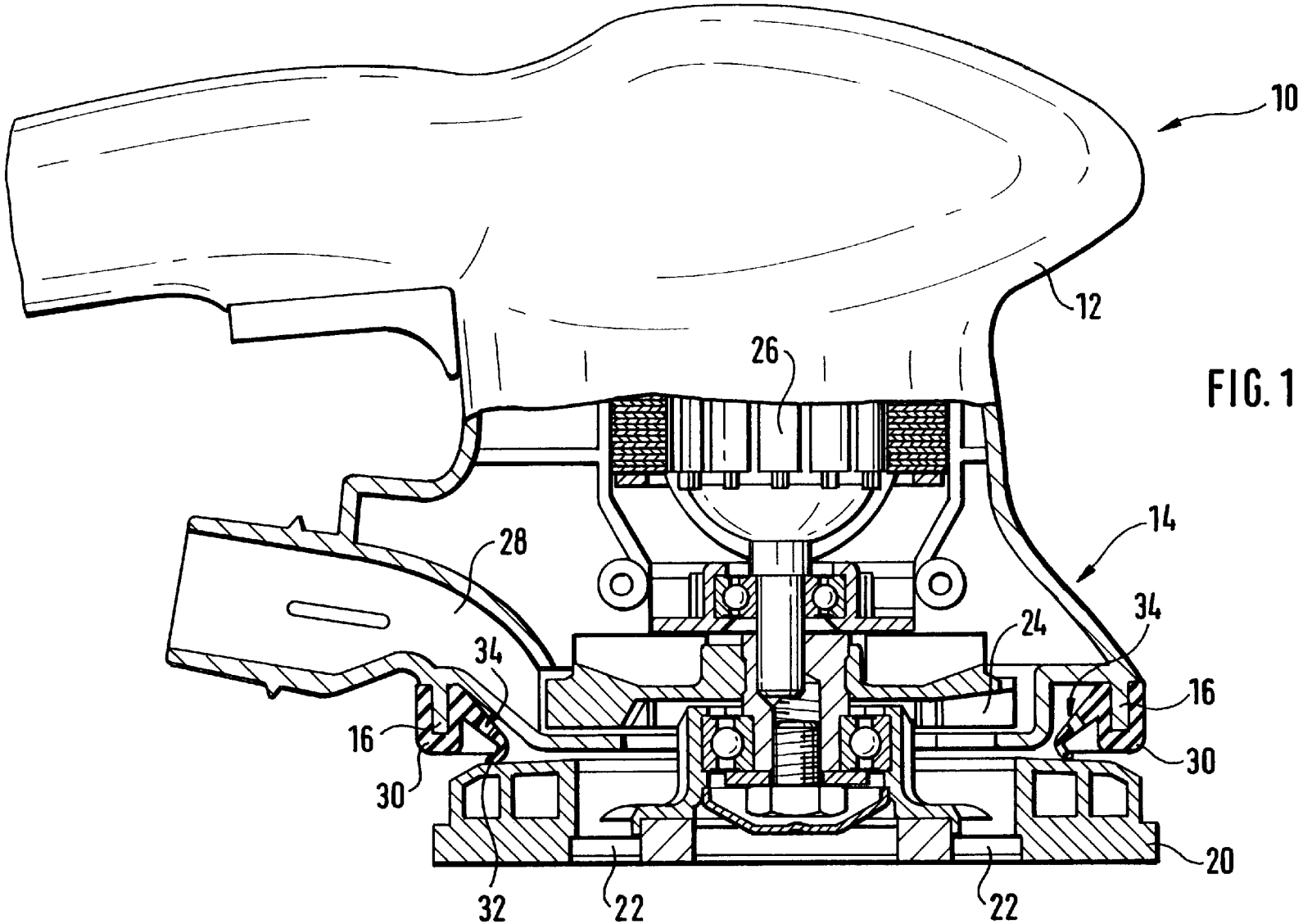
FIG. 1 is a view showing a longitudinal section of an eccentric plate grinder in accordance with the present invention.

FIG. 1 shows an eccentric plate grinding machine 10. It is composed substantially of a cylindrical bell-shaped housing 12 which in its lower region 14 has an end-side flat edge 16. An eccentrically motor-drivable rotatable grinding plate 20 is arranged axially near the edge. Its lower side is provided with recesses 22 which extend through the grinding plate 20 to the housing 12 and serves for the dust aspiration on the workpiece. A fan 24 is arranged in the interior of the lower region of the housing 12 and above the grinding plate 20. It is driven by the motor 26. The fan 24 also serves for cooling of the motor 26.

A ring-shaped rubber profile is arranged on the lower flat edge 16 of the housing 12 and forms a braking means 30.

The braking means 30 has a substantially two objectives. On the one hand the braking means 30 block the movement of the grinding plate 20 to prevent high speed of rotation of the unloaded grinding plate 20 to the rotary speed of the motor 26. On the other hand it closes the region between the housing 12 and the grinding plate 20 tightly from dust to secure a negative pressure for dust aspiration between the recesses 22 of the grinding plates 20, with the fan 24 and the suction pipe 28. The lip 32 of the braking means 30 is pressed strongly against the grinding plate 20 because of the negative pressure which is produced in the space above the grinding plate 20. Therefore, the braking force can be increased. In order to limit the braking force the braking mean 30 have valve-shaped throughgoing openings 34. They are automatically open and a predetermined negative pressure and reduce the pressure of the lip 32 against the upper side of the grinding plate 20.

Figure 2:
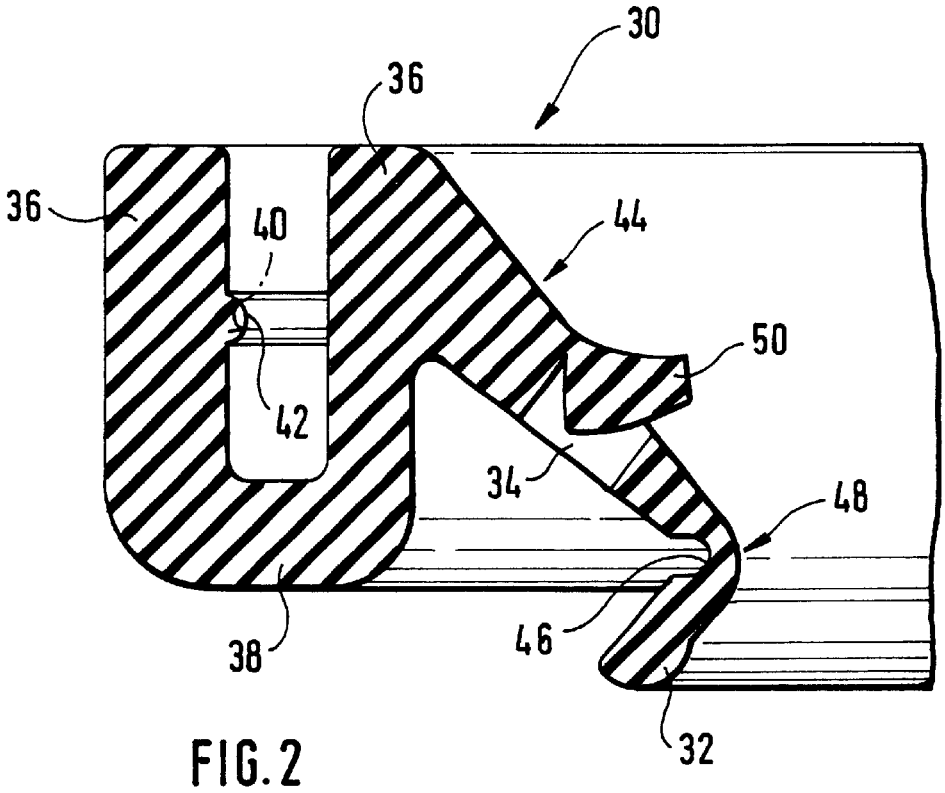
FIG. 2 is a view showing a transverse section of a ring-shaped braking means of the inventive grinder.

FIG. 2 shows the cross-section of the braking means 30 in detail. The ring-shaped braking means 30 has a region with a substantially U-shaped cross-section. The sides 36 of the leg regions or the end side 38 in the mounted condition form-lockingly embrace the edge 16 at the lower region 14 of the housing 12 and are held on it. For this purpose the edge 16 of the housing 12 has a ring groove 40 which is an engagement with the rib-shaped form-locking element 42 which forms a lifted portion in one side 36 of the braking means 30.

A further leg 44 is connected to the inner U-leg region. Its cross-section reduces outwardly and faces inwardly. At its lower end a ring groove 46 is provided and forms an end of the further leg 44. This end merges downwardly into the outwardly inclinedly facing lip 32. The lip 32 is composed of a straight portion with a thickening at its end. During the operation it is in contact with the grinding plate 20.

The further leg 44 between the inner leg and the lip 32 carries substantially centrally a valve-like throughgoing passage 44, which is closeable by flaps 50. The flaps are formed as partially-circular punched-out portions of the further leg 44. The punched-out portions are not completely carried out in the remaining circular portion, so that film-hinge-like regions are formed, about which the flaps are turnable. In this manner, the flap 50 is formed as a flappable circular element which is made of one piece, by mere punching from the braking element 30.

Figure 3:
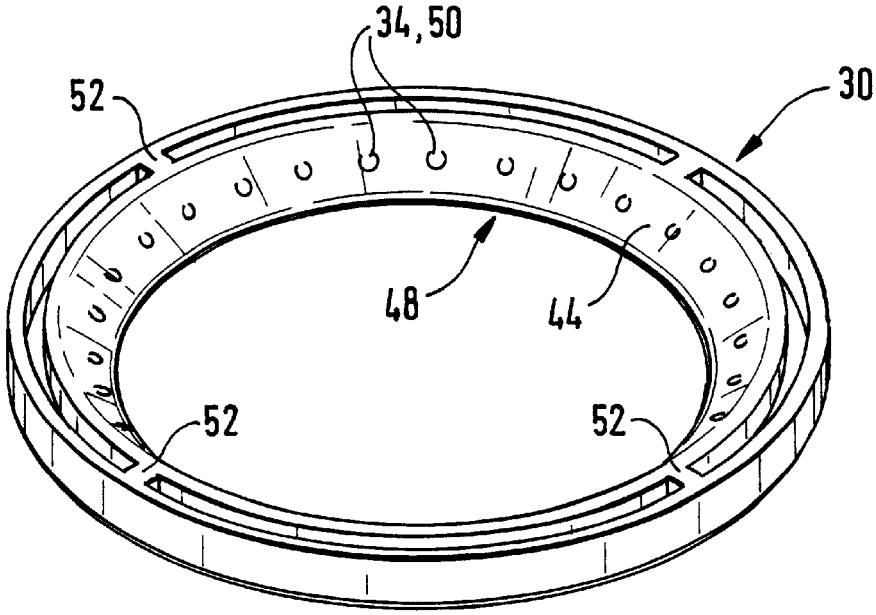
FIG. 3 is a prospective view of the braking means of the inventive grinder.

FIG. 3 shows the braking means 30 in a perspective view. The narrowing region 48 can be seen as a lower edge. The throughgoing passages 34 with the flaps 18 are arranged over the whole ring in the center of the further leg 44. For preventing a rotation of the braking means 30 with the grinding disc 20, the cross-section of the U-shaped structure of the braking means 30 is interrupted at several locations 52. At these locations the region between the both sides 36 of the U-leg region is complete. The housing 12 has for this purpose corresponding tooth-gap-shaped transverse grooves on the edge 16, so as to produce a radial form-locking connection between the braking means and the housing 12.

It will be understood that each of the elements described above, or two or more together, may also find a useful application in other types of constructions differing from the types described above.

While the invention has been illustrated and described as embodied in eccentric plate grinding machine with a cylindrical housing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. An eccentric plate grinder, comprising a cylindrical housing having a lower region with an end-side edge; a rotatable grinding plate associated with a lower region; a ring-shaped braking means positioned between said grinding plate and said edge, said grinding means having an elastic lip with which it is supported on said grinding plate and applies a braking force to said grinding plate, said braking means also tightly closing a suction chamber inside said housing in a region of said grinding plate from outside, said braking means having throughgoing openings for ventilating said suction chamber; and valve-shaped flaps operative for releasing and closing said throughgoing openings.

2. An eccentric plate as defined in claim 1, wherein said braking means at a side which faces away from said suction chamber is provided with a circumferential ring groove which reduces a wall thickness, elastic lip extending from said ring groove in an axial direction toward said grinding plate.

3. An eccentric plate as defined in claim 2, wherein said ring groove has a region which is formed as an elastic hinge for a movability of said elastic lip relative to a remaining portion of said braking means.

4. An eccentric plate as defined in claim 1, wherein said braking means has a U-shaped cross-section with legs.

5. An eccentric plate as defined in claim 4, wherein said legs engage around and are held on sides of said lower region of said housing.

6. An eccentric plate as defined in claim 4, wherein said legs engage around and are held on an end side of said lower region of said housing.

7. An eccentric plate as defined in claim 4, wherein said braking means has an inner leg and a further leg which is connected with said inner leg and has a reducing cross-section inclined inwardly and downwardly, said further leg being angled inclinedly outwardly in a region of a ring groove and forming there a lip.

8. An eccentric plate as defined in claim 4, wherein said braking means in a region of an outer leg has a greater outer diameter than said lower region of said cylindrical housing so that it extends beyond an outer contour of said housing and operates as a bumper.

9. An eccentric plate as defined in claim 7, wherein said valve-shaped flaps are formed as throughgoing punched parts and are of one piece with said further leg.

10. An eccentric plate as defined in claim 9, wherein said flaps are formed as U-shaped punched out portions.

11. An eccentric plate as defined in claim 9, wherein said flaps are formed as partially circular punched out portions.

12. An eccentric plate as defined in claim 1, wherein said flaps have mounting regions which are formed as punched-in portions to produce film hinges.

* * * * *